US005097564A

United States Patent [19]

Billings

[11] Patent Number: 5,097,564

[45] Date of Patent: Mar. 24, 1992

[54] SOOT BLOWER

[75] Inventor: Royce A. Billings, Girard, Pa.

[73] Assignee: White Consolidated Industries, Inc., Cleveland, Ohio

[21] Appl. No.: 578,595

[22] Filed: Sep. 4, 1990

[51] Int. Cl.[5] ..... F23J 3/02

[52] U.S. Cl. ..... 15/316.1; 15/318

[58] Field of Search ..... 15/316.1, 318, 317

[56] References Cited

U.S. PATENT DOCUMENTS

| | | | |
|---|---|---|---|
| 3,604,050 | 9/1971 | Nelson et al. | 15/317 |
| 4,177,539 | 12/1979 | Elting | 15/316.1 |
| 4,207,648 | 6/1980 | Sullivan et al. | 15/316.1 |
| 4,222,144 | 9/1980 | Hörner et al. | 15/317 |
| 4,351,082 | 9/1982 | Ackerman et al. | 15/316.1 |
| 4,387,481 | 6/1983 | Zalewski | 15/316.1 |
| 4,437,201 | 3/1984 | Zalewski | 15/316.1 |
| 4,498,213 | 2/1985 | Zalewski | 15/316.1 |

*Primary Examiner*—Harvey C. Hornsby
*Assistant Examiner*—Reginald L. Alexander
*Attorney, Agent, or Firm*—Pearne, Gordon, McCoy & Granger

[57] ABSTRACT

A boiler soot blower provides a lance tube having a pair of opposed nozzles at its end. The lance tube is carried by a carriage for reciprocation between an extended and retracted position, and is caused to rotate about its longitudinal axis in timed relationship to the extension and retraction. A lost motion drive is provided for the rotation of the lance tube so that the nozzles produce a helical first spray pattern of cleaning fluid during extension and a second spray pattern of cleaning fluid during retraction which is offset from the first spray pattern and extends substantially midway between the adjacent portions of the first spray pattern. This results in a composite pattern which provides efficient cleaning.

3 Claims, 2 Drawing Sheets

SOOT BLOWER

BACKGROUND OF THE INVENTION

This invention is directed to soot blowers for cleaning the interior surfaces of boilers by discharging suitable cleaning fluid from nozzles against such surfaces. More particularly, the invention relates to a novel and improved sot blower having a simplified drive system operable to produce an effective and efficient nozzle spray pattern as the nozzles are moved back and forth along the surfaces to be cleaned.

PRIOR ART

Typically, in soot blowers of the long retracting or recovery type, a lance tube is moved through long paths of travel horizontally forward into the heat exchange zone of large public utility boilers or pulp and paper mill recovery boilers, and thereafter retracted to its original starting position. During the traveling motion of the lance tube, the tube is rotated about its longitudinal axis, and a cleaning fluid is discharged through a nozzle mounted on the forward end of the tube so that the fluid may be directed against the various internal surfaces of the boiler to remove undesirable soot accumulations. Various means have been provided for imparting both the linear and rotational movement of the lance tube during the traveling motion through a complete cleaning cycle.

One example of such a soot blower is illustrated in U.S. Pat. No. 4,437,201 to Zalewski. Such patent is assigned to the assignee of the present invention and is incorporated herein in its entirety.

SUMMARY OF THE INVENTION

The present invention is directed to the provision of an effective and efficient spray pattern for soot blowers, while utilizing a simple and reliable drive system.

In accordance with the present invention, a lance tube is rotated about its longitudinal axis as it is reciprocated back and forth between extended and retracted positions. Nozzle means are provided in the forward end of the lance tube through which cleaning fluid passes to provide cleaning of the interior surfaces of a boiler. A drive is provided to cause such rotation in timed relationship to the reciprocation movement so that as the lance extends, its rotation is timed to provide a first helical spray pattern of cleaning fluid passing through the nozzles. The drive is also arranged so that a second spray pattern produced during the retraction is offset from the first spray pattern. The offset is selected so that the extension spray pattern and retraction spray pattern interleave and provide a composite spray pattern providing substantially complete and efficient coverage of the boiler surfaces to be cleaned. In the illustrated embodiment, the spray pattern during retraction extends midway between the adjacent portions of the spray pattern produced during extension.

In accordance with another aspect of this invention, a novel and improved lance drive is provided in which the reciprocation drive of the lance support carriage provides the rotary drive for the lance, and wherein the lance drive operates to offset the nozzle spray pattern during lance retraction from the spray pattern produced during lance extension.

In the illustrated embodiment, the offset is provided by a simple lost motion connection within the lance drive system. With this invention, an effective spray pattern is efficiently provided with a simple and reliable mechanism.

These and other aspects of this invention are illustrated in the accompanying drawings, and are more fully described in the following specification.

DETAILED DESCRIPTION OF THE DRAWINGS

Figure 1:
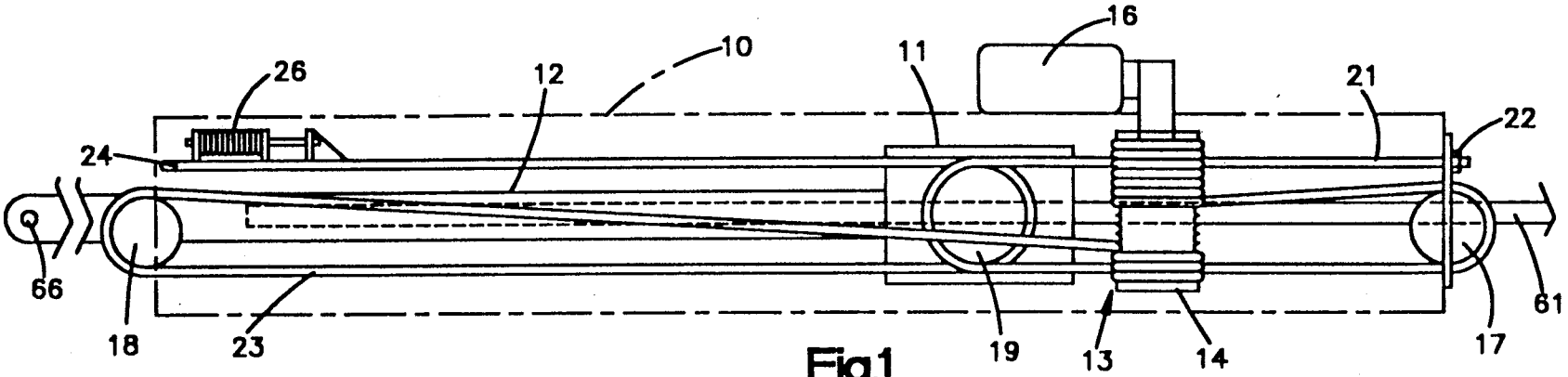
FIG. 1 is a schematic plan view of the carriage drive of one preferred embodiment of a soot blower in accordance with the present invention, illustrating the housing in phantom.

FIG. 1 schematically illustrates the overall soot blower in accordance with the present invention. The soot blower includes an elongated housing, illustrated in phantom at 10, and a carriage 11 reciprocable back and forth along the length of the housing 10. For a detailed description of the manner in which the housing is constructed and the manner in which the carriage is supported within the housing for reciprocation along the length thereof, reference should be made to U.S. Pat. No. 4,437,201, incorporated by reference, supra. Mounted on the carriage 11 is a lance tube 12 which extends from the left end of the housing 10 (as illustrated in FIG. 1) and is caused to extend and retract as the carriage 11 moves back and forth along the housing 10.

A cable drive 13 is provided to cause the reciprocation of the carriage 11 back and forth along the housing 10. The drive includes a drum 14 driven by a motor 16, a pair of idler pulleys 17 and 18, and a driven pulley 19 journaled on the carriage 11. A first cable 21 is anchored at one end 22 and extends from the anchored end 22 around the driven pulley 19 and therefrom to the idler pulley 17 and back to the drum 14 to which the other end of the cable 21 is anchored. A second cable 23 is anchored at one end 24 and extends around the driven pulley 19. From the driven pulley 19, the second cable 23 extends around the idler pulley 18 and back to the drum 14, where its other end is anchored. The end 24 of the second cable 23 is anchored in a springtensioning device 26, which operates to maintain proper tension in the entire cable system.

When the drum is rotated in one direction, one of the cables 21 or 23 is wound onto the drum and simultaneously the other cable is unwound or released from the drum an equal amount. This causes the carriage 11 to be moved along the housing 10 in one direction when the drum rotates in the first direction and causes carriage movement in the opposite direction when the drum is rotated in the opposite direction. At the same time the driven pulley 19 is caused to rotate in timed relationship with the reciprocation of the carriage 11. It is this rotation of the driven pulley 19 which provides the rotation of the lance pulley during the reciprocation of the carriage. Here again, reference may be made to U.S. Pat. No. 4,367,201 for a more detailed description of the operation of the cable drive which simultaneously causes reciprocation of the carriage 11 and rotation of the lance tube 12.

Figure 2:
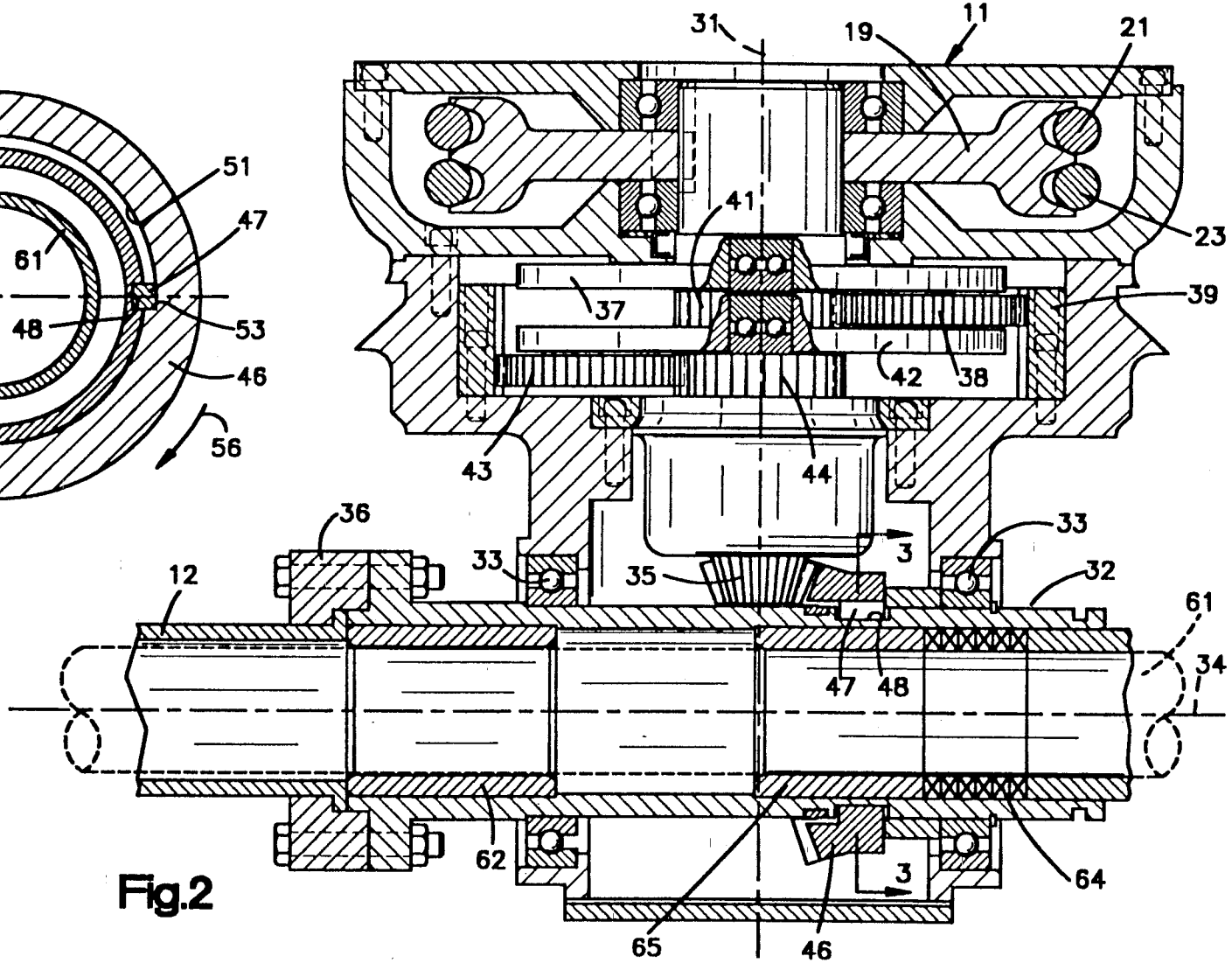
FIG. 2 is a fragmentary section illustrating the lance tube rotational drive provided on the carriage and which operates to rotate the lance tube in timed relationship to the reciprocating movement of the carriage and lance tube.
Figure 3:
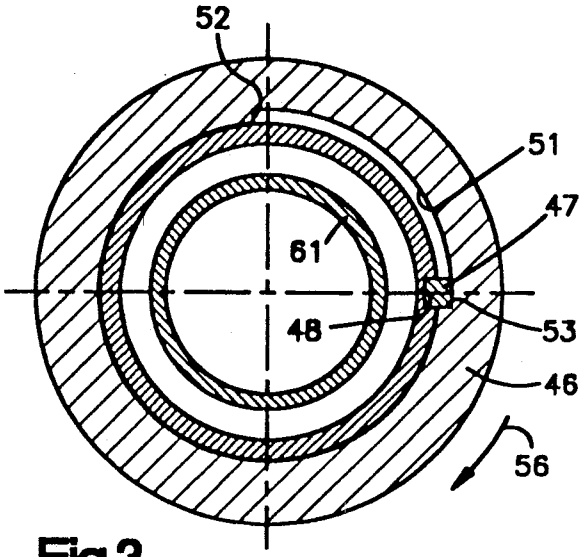
FIG. 3 is an enlarged, fragmentary section taken along line 3—3 of FIG. 2, illustrating the lost motion drive.

In accordance with the present invention, however, a simplified drive is provided to cause the rotation of the lance tube in response to the rotation of the driven pulley 19 and the drive is arranged to provide a composite spray pattern which effectively cleans the surfaces of a boiler. Referring to FIGS. 2 and 3, the driven pulley 19 is journaled in the carriage 11 for rotation about a pivot axis 31. Since the movement of the carriage by the cables 21 and 23 produces both the reciprocation of the carriage and the rotation of the driven pulley 19, such movements are illustrated and are in timed relationship.

A planetary gear system is provided to cause rotation of a spindle 32 journaled in bearings 33 for rotation within the carriage 11 about its longitudinal axis 34. The axis 34 perpendicularly intersects the axis 31.

Mounted on the spindle 32 by a mounting collar 36 is the inner end of the lance tube 12. This mounting is structured to cause the lance tube to rotate with the spindle 32 as it is reciprocated back and forth by the reciprocation of the carriage 11. Consequently, the spindle is part of a lance tube assembly.

The planetary gear drive is provided between the driven pulley 19 and a drive gear 35. This gear drive includes a double planetary gear system. A first planetary gear set includes a spider 37 connected to the driven pulley 19 for rotation therewith. The spider carries a set of planet gears 38. In order to better illustrate the structure, FIG. 2 only illustrates one of each set of planet gears. In practice, however, each set of planet gears includes at least two planet gears so that the planet gears cooperate with the ring gear 39 to laterally position each planet system. Rotation of the planet gears 38 causes rotation of the sun gear 41 provided by a spider 42 of the second planetary gear system. Therefore, as the planet gears 38 are carried around the ring gear 39 by the spider 37, the second spider 42 is caused to rotate and carries with it a second set of planet gears 43. Similarly, as the second planet gears 43 are carried around the ring gear 39, a second sun gear 44 is rotated, causing rotation of the drive gear 35 around the axis 31. Preferably, thrust bearings are provided to vertically position the two spiders 37 and 42 along with their associated sun gears 41 and 44.

The drive gear 35 meshes with a tubular gear 46 which extends around and embraces the spindle portion 32. A key 47 mounted in a keyway 48 in the spindle portion 32 provides a driving connection between the tubular driven gear 46 and the spindle 32. However, this driving connection is provided with lost motion in a manner best illustrated in FIG. 3.

The key 47 extends into a recess 51 formed in the gear 46 and which extends peripherally through 90 degrees plus the width of the key 47 from an end face 52 to an opposite end face 53. When the gear 46 is rotated in a clockwise direction, indicated by the arrow 56 in FIG. 3, the key moves into engagement with the end face 53 and once such engagement is established, continued rotation of the gear 46 causes similar rotation of the spindle 32. Thereafter, when the gear 46 is rotated in the opposite or anti-clockwise direction, the gear rotates freely relative to the spindle 32 in an anticlockwise direction through 90 degrees until the key 47 engages the end 52 of the recess 51, after which co-rotation in an anticlockwise direction occurs. With this simple lost motion connection, an indexing occurs between the driven gear 46 and the spindle through 90 degrees each time the direction of rotation of the driven gear 46 is reversed. This produces an offset in the spray pattern produced during retraction from the spray pattern produced during extension.

Cleaning fluid, such as steam, is supplied to the lance tube by a supply tube 61 (illustrated in FIG. 2) mounted on the housing 10. The supply tube is preferably connected to a supply of cleaning fluid through a valve (not illustrated). The supply tube 61 extends lengthwise of the housing and telescopes with the spindle 32 and lance tube 12. Supply tube 61 is guided through spindle 32 by bushings 62 and 65. A seal 64 mounted in the spindle 32 engages the outer surface of the supply tube 61 to provide a fluidtight dynamic seal therewith, so that cleaning fluid is supplied to the lance tube 12 as the carriage is reciprocated back and forth.

Figure 4:
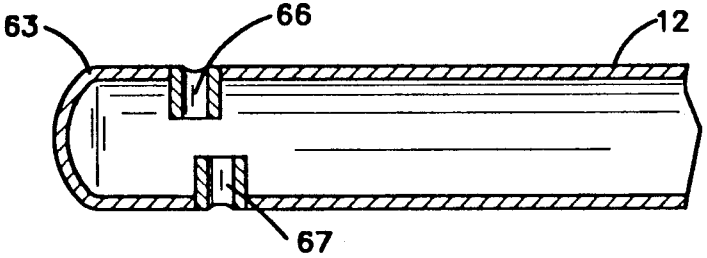
FIG. 4 is a fragmentary section illustrating the nozzles provided at the end of the lance tube.

Referring to FIG. 4, the forward end 63 of the lance tube 12 is provided with opposed nozzles 66 and 67, which extend in opposite directions, and therefore direct fluid in opposite directions from the lance tube against the surfaces of the boiler being cleaned. These nozzles 66 and 67 are axially offset a slight amount so that they do not restrict the flow to each other. However, since such longitudinal offset is very small, the spray pattern produced from the two nozzles 66 and 67 is, for all practical purposes, 180 degrees out of phase.

Figure 5:
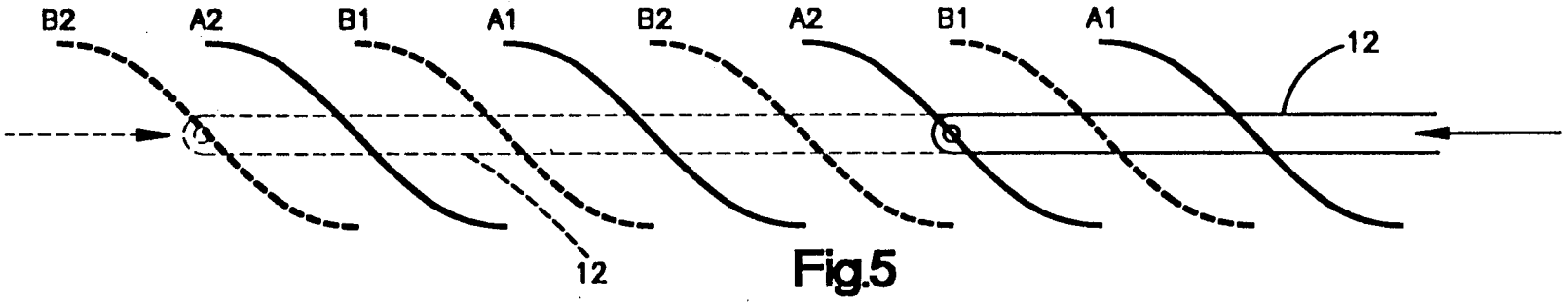
FIG. 5 is a schematic view illustrating the manner in which the spray patterns produced during extension interleave with the spray pattern produced during retraction of the lance tube.

In operation, the soot blower produces a spray pattern, best illustrated in FIG. 5. As the lance tube 12 extends, the cleaning fluid passing through the two opposed nozzles 66 and 67 produces a helical pattern, represented by the lines A1 and A2. Because the two nozzles are 180 degrees apart, the spray path Al is 180 degrees out of phase with the spray pattern A2, and the longitudinal spacing between the two paths A1 and A2 is equal to one-half the lead provided by the drive system.

For example, if the drive system rotates the lance tube through one complete revolution each time the carriage is moved five inches, a helix angle results which produces a lead of five inches per revolution. In that event, the path of the spray pattern A2 is longitudinally spaced from the path of the spray pattern A1 by two and one-half inches. (The slight offset of the two nozzles is neglected for purposes of illustration.) On extension, the spray pattern indicated by the lines A1 and A2 is repeated in a helical manner, with approximately two and one-half inches spacing between each spray path in the example mentioned above.

When the lance tube is fully extended at the end of the carriage travel on extension, the direction of the motor 16 is reversed, causing the cable driven to commence retraction of the carriage and the lance tube. However, since a lost motion connection is provided for the first 90 degrees of rotation of the spindle 32, the lance tube is carried back through a distance equal to one-fourth of the helix lead before it commences to rotate. Because the direction of travel of the carriage is reversed, the direction of rotation of the driven pulley 19, and in turn the direction of rotation of the spindle 32 and lance tube 12, is also reversed. However, because of the lost motion indexing action, the spray pattern is offset during retraction from the spray pattern produced on extension.

On retraction, the spray pattern B1 and B2 occurs. The spray pattern during retraction is offset from the spray pattern during extension an amount which effectively divides the spacing between the extension spray pattern. In other words, the retraction spray pattern is offset and extends substantially midway from the adjacent portions of the extension spray pattern. Therefore, in the example mentioned above, in which the lead of the helix is equal to five inches, producing a spacing between the spray pattern during extension of two and one-half inches, the spray pattern produced on retraction is spaced from the spray pattern produced during extension by only about one and one-quarter inches. Therefore, virtually complete coverage is provided by the composite spray pattern and efficient soot cleaning is produced.

This indexing or offset of the two spray patterns, so that they interleave, is accomplished by the simple expedient of providing a lost motion connection within the rotary drive. In the illustrated embodiment, this lost motion connection is provided by the simple structure of a recess 51 which extends along the periphery of the gear 46 a distance equal to 90 degrees plus the width of the key 47. Consequently, the indexing through one quarter of a revolution, or 90 degrees, occurs each time the direction of rotation of the carriage is reversed by virtue of a simple, low cost, reliable structure.

Although the preferred embodiment of this invention has been shown and described, It should be understood that various modifications and rearrangements of the parts may be resorted to without departing from the scope of the invention as disclosed and claimed herein.

What is claimed is:

1. A soot blower comprising a frame, a carriage mounted on said frame for movement between an extended position and a retracted position, a lance tube having a longitudinal axis journalled on said carriage for rotation relative thereto about said longitudinal axis and reciprocable with said carriage along said axis between said extended and said retracted positions, power means connected to by axial drive to reciprocate said carriage and connected by a rotary drive to rotate said lance tube, said power means including a driven pulley journalled on said carriage for rotation about a second axis perpendicularly intersecting said longitudinal axis, said power means being connected to said driven pulley to cause said carriage to reciprocate and to rotate said driven pulley about said second axis, said rotary drive providing reduction gearing extending along said second axis driven by said second driven pulley and providing a beveled drive gear connected to said reduction gearing for rotation about said second axis, a beveled driven gear journalled on said lance tube and connected thereto to rotate said lance tube about said longitudinal axis, said driven gear being engaged by sand driven by said beveled drive gear, and a lost motion connected between one of said beveled gears and its associated connection, said lost motion connection in said rotary drive allowing said lance tube to longitudinally move through a predetermined distance without rotation to offset a helical spray pattern produced during extension from a helical spray pattern produced during retraction.

2. A soot blower as set forth in claim 1, wherein said power means providing a cable system including a driven pulley journalled on said carriage constituting part of said rotary drive, operation of said cable system causing said driven pulley to reciprocate said carriage and rotate said pulley relative to said carriage in time relationship to the reciprocation thereof.

3. A soot blower as set forth in claim 2, wherein said lost motion connection is provided by a gear journaled on said lance tube and connected thereto by a key movable along a recess extending substantially 90 degrees along the periphery of said lance tube, said nozzle including two opposed nozzles.

* * * * *

UNITED STATES PATENT AND TRADEMARK OFFICE

CERTIFICATE OF CORRECTION

PATENT NO. : 5,097,564

DATED : March 24, 1992

INVENTOR(S) : Royce A. Billings

It is certified that error appears in the above-identified patent and that said Letters Patent is hereby corrected as shown below:

Column 6, line 18, "sand" should read --and--.

Signed and Sealed this

Thirteenth Day of July, 1993

Michael K. Kirk

*Attest:*

MICHAEL K. KIRK

*Attesting Officer*

*Acting Commissioner of Patents and Trademarks*